US009182116B2

(12) United States Patent
Murray

(10) Patent No.: US 9,182,116 B2
(45) Date of Patent: Nov. 10, 2015

(54) EFFICIENT SOLID FUEL BURNING APPLIANCE

(76) Inventor: Andrew Murray, Columbia, SD (US)

( * ) Notice: Subject to any disclaimer, the term of this patent is extended or adjusted under 35 U.S.C. 154(b) by 918 days.

(21) Appl. No.: 12/797,593

(22) Filed: Jun. 9, 2010

(65) Prior Publication Data

US 2010/0313798 A1 Dec. 16, 2010

Related U.S. Application Data

(60) Provisional application No. 61/268,232, filed on Jun. 10, 2009.

(51) Int. Cl.

| | |
|---|---|
| ***F23K 3/00*** | (2006.01) |
| ***F23B 80/04*** | (2006.01) |
| ***F23B 60/02*** | (2006.01) |
| ***F23L 13/00*** | (2006.01) |
| ***F23L 17/00*** | (2006.01) |
| ***F23M 7/00*** | (2006.01) |
| ***F23M 11/04*** | (2006.01) |

(52) U.S. Cl.

CPC ..... *F23B 80/04* (2013.01); *F23B 60/02* (2013.01); *F23L 13/00* (2013.01); *F23L 17/00* (2013.01); *F23M 7/00* (2013.01); *F23M 11/042* (2013.01)

(58) Field of Classification Search

CPC ..... F23K 3/00; F23M 7/00; F23H 17/00; F23B 80/00

USPC ..... 126/168, 500, 517, 518, 526, 530; 110/267, 268, 287, 288

See application file for complete search history.

(56) References Cited

U.S. PATENT DOCUMENTS

| | | | | | |
|---|---|---|---|---|---|
| 2,371 | A | | 11/1841 | Stewart | |
| 115,958 | A | | 6/1871 | Hewes | |
| 118,629 | A | | 8/1871 | Miles | |
| 154,398 | A | | 8/1874 | Kendall | |
| 266,393 | A | | 10/1882 | Schoneberg | |
| 852,209 | A | | 4/1907 | Watson | |
| 1,724,461 | A | * | 8/1929 | Dienne | 126/182 |
| 2,378,376 | A | * | 6/1945 | Ackron | 110/288 |
| 2,380,630 | A | * | 7/1945 | Cross | 126/152 R |
| 3,220,400 | A | * | 11/1965 | Yager | 126/531 |
| 4,291,669 | A | | 9/1981 | Herne | 126/83 |
| 4,320,741 | A | | 3/1982 | Pierce | 126/123 |
| 4,384,535 | A | * | 5/1983 | McKelvie | 110/165 R |

(Continued)

*Primary Examiner* — Gregory Huson
*Assistant Examiner* — Aaron Heyamoto
(74) *Attorney, Agent, or Firm* — Antonio Papageorigiou, Esq.; Meister Seelig & Fein LLP

(57) ABSTRACT

A wood or other bio mass fueled appliance is disclosed for maximum efficiency and low cost construction for home, garage, workshop, and barn. Comprised of a vertical cylindrical outside shell (12) outside bottom (16) and outside top (14) enclosing an inside shell (24) inside bottom (28) and inside top (26). Inside shell (24) forming a vertical cylindrical chamber (36) accessed by load door (38) and ash door (40), through which disassembled baffles (32) may pass. A suitable means for igniting fuel in chamber (36) and controlling burn rate by draft regulators (42) and fan limit switches (52). Whereby circular baffles (32) elevated by 90° angle shaped supports (30) suppress the flow of flame and exhaust gases from entering flue (22). Exhaust gases and flame pass by gap (50), directing energy toward the inside surface of inside shell (24) inside bottom (28) and inside top (26). Thus maximizing the efficiency of heat transferred from chamber (36) to the air or fluid in space (18) circulated through ducts (20) by blowers/pumps (48) and directed by air deflectors (46) producing economizing results.

13 Claims, 6 Drawing Sheets

(56) References Cited

U.S. PATENT DOCUMENTS

| | | | | | |
|---|---|---|---|---|---|
| 4,426,937 | A | * | 1/1984 | Sietmann et al. | 110/288 |
| 4,470,400 | A | * | 9/1984 | Fleisler | 126/522 |
| 4,471,753 | A | * | 9/1984 | Yates | 126/110 R |
| 4,520,791 | A | | 6/1985 | Chamberlain | 126/121 |
| 4,577,616 | A | | 3/1986 | Lillo | 126/110 R |
| 4,596,231 | A | | 6/1986 | Chelminski | 126/67 |
| 4,597,375 | A | | 7/1986 | Pabis | 126/117 |
| 4,832,000 | A | * | 5/1989 | Lamppa et al. | 126/77 |
| 5,024,208 | A | | 6/1991 | Hottenroth et al. | 126/25 R |
| 5,054,405 | A | * | 10/1991 | Walker | 110/254 |
| 5,263,471 | A | * | 11/1993 | Shimek et al. | 126/528 |
| 2007/0029316 | A1 | * | 2/2007 | Fernandez | 219/730 |
| 2008/0316284 | A1 | * | 12/2008 | Osawa et al. | 347/85 |

* cited by examiner

EFFICIENT SOLID FUEL BURNING APPLIANCE

This application claims priority to U.S. Provisional Application No. 61/268,232, filed Jun. 10, 2009, which is hereby incorporated herein by reference.

BACKGROUND OF THE INVENTION

This application relates generally to an appliance for burning solid fuels, such as wood, corn, pellets, etc., and more specifically for better combustion, more efficient heat distribution, and more economical construction.

With the increased price of energy, especially the fossil fuels, interest in alternative energy sources, mainly wood derived, to heat the interior space of any structure needing a rise in temperature has grown significantly over the past years, largely by moderate income families trying to reduce the bite of inflation, but also by a sizable segment of low income families who simply cannot afford fossil derived fuels.

Wood-burning devices have been well known for a long time, however, their popularity fluctuates. When petroleum fuel is readily available and reasonably priced, wood burning devices use declines. Recently we have seen a resurgence of interest in the use of wood and other bio-mass fuels as a heating fuel. Many of the reasons for the increase include rising petroleum fuel costs, the availability of wood and alternative fuels, and the staggering effects mining, drilling, processing, transporting and the burning of fossil fuels have on the environment. A problem with existing wood-based and other solid fuel burning appliances, however, is their lack of efficiency. That is, they are inefficient in many ways. First, known wood burning appliances must generate more heat than comparable petroleum fired furnaces, in order to adequately warm remote parts of the space in which it is situated. Moreover, existing wood-based and other solid fuel devices generally tend not to burn their fuel as completely as petroleum fueled furnaces and a significant amount of heat escapes directly out the flue. The, e.g., rectangular or square, shape of known appliances also have many design flaws. As a result, the cost advantages of burning wood or solid fuel over petroleum based fuels are diminished.

The resurgence of the interest in burning wood over fossil fuels may also be attributed to the many benefits of burning of wood over fossil fuels. One of the largest benefits of burning wood over fossil fuels is that a person can harvest, process and store wood with minimal harmful affects to the environment. For example, if a pile of wood is spilled, there is no harm to the environment. In contrast, if petroleum fuel is spilled, there is a very large pollution control cost associated therewith. The storing of fossil fuels also requires special containers, whereas wood fuel can simply be piled on the ground or placed inside a structure where it is going to be used. In addition, wood supply is easily accessed by most individuals who are independent and interested in not being dependent on large petroleum corporations who often fluctuate price for the benefit of the corporation and not the individual consumer.

There are many ways in which wood fired and petroleum fired furnaces are not directly comparable. For instance, a pound of wood is not directly comparable to a pound of oil. Oil will flow into a furnace while wood has to be physically loaded after the fire cools down. In this example labor required to deliver the fuel for combustion is not directly comparable from one type of furnace to the other.

There are many ways in which wood fired and petroleum fired furnaces are comparable. Since wood is a simple compound, made up of less elements, less waste is generated. Unburned oil puts hydrocarbons into the air and wood does not. Hydrocarbons from fossil fuels are suggested to be the cause of global warming and not the burning of wood. Trees grow by taking all that is needed out of the air and soil to grow. Thus, when burned, other growing trees will absorb what was put into the air. Oil is nonrenewable.

In comparing wood furnaces with one another. The current obstacle with wood is efficiently burning the wood and distributing the wood's heat in a structure. A problem with existing wood furnaces is their lack of efficiency. Rectangular wood stoves need more fuel to overcome the flaw of their shape. Because square or rectangle wood furnaces have cold spots and hot spots they tend to be operated very hot when re-fueled and a comfortable temperature is trying to be reached. They are inefficient in two other ways. A wood furnace must generate more heat, than petroleum fired furnaces, in order to adequately warm remote parts of the space in which it is situated. Existing wood burning devices generally do not burn their fuel as completely as petroleum fueled furnaces. A significant amount of heat escapes directly out the flue. Rectangular in nature wood burning furnaces have hot spots in the back primarily due to the existence of their corners. As a result, the cost advantages of burning wood or solid fuel over petroleum based fuels are diminished.

From the above, it can be seen what is a need for a device that is easy-to-use, more economical to produce, and efficient to use.

SUMMARY OF THE INVENTION

The present invention is a device for burning wood or other solid fuels with more efficient heat distribution and a more economical construction.

There are many objects of the present invention in its various embodiments that may be addressed individually or in combinations and permutations. Each embodiment may address one or several of the following objectives.

An object of this invention in one embodiment or variant of the invention is to provide an appliance for efficiently distributing heat from wood-based fuel or other solid fuel.

Another object of this invention in one embodiment or variant of the invention is to provide a device for a more economical construction.

Another object of this invention in one embodiment or variant of the invention is to provide a device that limits or eliminate smoke that comes out the loading door due to the position of the baffle.

Another object of this invention in one embodiment or variant of the invention is to provide a device without a hot spot in the back due to the shape, position, and use of baffles.

Another object of this invention in one embodiment or variant of the invention is to provide a device without hot or cold spots.

Another object of this invention in one embodiment or variant of the invention is to provide a device with more longevity from operational burnout deterioration.

Another object of this invention in one embodiment or variant of the invention is to provide a device with heat baffles that can be serviced through the appliance's load door.

Another object of this invention in one embodiment or variant of the invention is to provide a device with self centering heat baffles.

Another object of this invention in one embodiment or variant of the invention is to provide a device that ensures against eventual operational warping of the fire chamber.

Another object of this invention in one embodiment or variant of the invention is to provide an appliance that can have a three piece fire grate that has a two piece constructed exterior circumference design with a ship lap construction that would accept a circular center piece that was constructed with a ship lap exterior edge, to allow once all assembled a twisting or shaking action of the center grate that will travel by the support of the outside grates.

Another object of this invention in one embodiment or variant is to provide an appliance that can have a friction/compression closure system for the sealing of the load door and ash door. The closure system will be comprised of a lever that rotates on a axis with a tensioning devise (possibly springs) on each side to provide compression and a door that has a surface that the latch will mate with and that surface can have a raised angled step to help with said compression.

Another object of this invention in one embodiment or variant is to provide an appliance that can have a two speed blower that can switch from low speed to high speed or from high speed to low speed automatically.

Another object of this invention in one embodiment or variant is to provide an appliance that can have an outside shell that encases the entire inside shell except the loading door area, ash door area and flue exhaust pipe.

Another object of this invention in one embodiment or variant is to provide an appliance that can use different fuels in the fire box such as solid firewood, wood pellets, wood chips, manufactured or pressed logs, corn, corn cobs or any other solid fuel.

Another object of this invention in one embodiment or variant is to provide an appliance that can have a different fuel delivery system such as feed door for hand placement of firewood, feed augur for corn or wood pellet, conveyor, or other means.

Another object of this invention in one embodiment or variant is to provide an appliance that can have different systems of evacuating convection heat off from the fire box, such as air forced by a blower or fan through space between the fire box and outer shell or use of a liquid pumped or not pumped between the fire box and outer shell.

Another object of this invention in one embodiment or variant is to provide an appliance that can have an air wash system for the cleaning of glass in the load door.

These and other objects and advantages of the invention will be clear in view of the following description of the invention including the associated drawings.

BRIEF DESCRIPTION OF THE DRAWINGS

The invention will be described hereafter in detail with particular reference to the drawings. Throughout this description, like elements, in whatever embodiment described, refer to common elements wherever referred to and referenced by the same reference number. The characteristics, attributes, functions, interrelations ascribed to a particular element in one location apply to that element when referred to by the same reference number in another location unless specifically stated otherwise. All Figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength and similar requirements will likewise be within the skill of the art after the following description has been read and understood.

DRAWINGS REFERENCE NUMERALS

Figure 1:
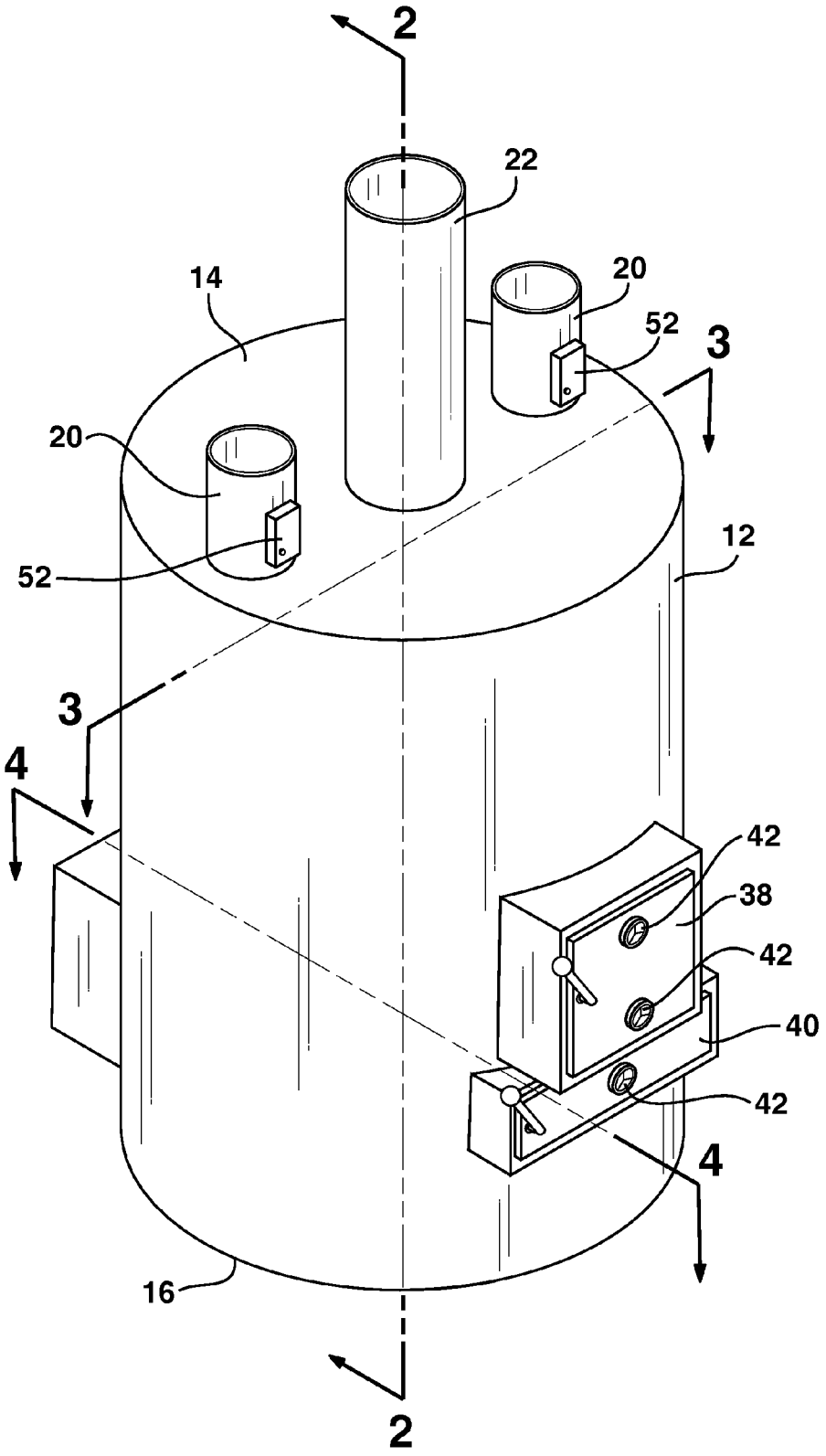
FIG. 1 is a perspective view of an appliance for burning solid fuels.

12 outside shell
14 outside top
16 outside bottom
18 space
20 duct
22 flue
24 inside shell
26 inside top
28 inside bottom
30 baffle support
32 baffle
34 notch
36 chamber
38 load door
40 ash door
42 draft regulator
44 support
46 deflector
48 blower/pump
50 gap
52 switch
54 fire grate
56 first grate section
58 second fire grate section
60 center fire grate
62 window
64 air wash system

DETAILED DESCRIPTION

Preferred embodiments of the invention will now be described, by way of example only and not to limit the invention, with reference to the accompanying drawings.

FIG. 1 is a perspective view of an appliance for burning solid fuels according to at least one embodiment of the appliances disclosed herein. The appliance, e.g., a furnace, boiler, etc., is comprised of an outer shell 12, an outside bottom 16 and outside top 14. The outer shell 12 is a vertical cylinder in the preferred embodiment. General construction of the appliance is from A36 mild sheet steel or any other material suitable for this means. The material may be joined by welding or by any other method suitable for joining the construction material. Protruding from the outside top 14 of the appliance is a flue 22 and one or more ducts 20. Protruding from the back of the outside shell 12 is a housing containing one or more blowers/pump 48, controlled by one or more fan limit switches 52. Protruding from the front of the outside shell 12 is a load door 38 and ash door 40. Load door 38 may or may not contain one or more draft regulator's 42. In the preferred embodiment load door 38 contains two draft regulator's 42 and may contain a glass window 62 to view combustion. The glass window 62 may be serviced by an air wash system 64 for keeping the glass clean. By means of redirecting airflow from one or more draft regulators 42. Ash door 40 may or may not contain one or more draft regulator's 42. In the preferred embodiment, ash door 40 contains one draft regulator 42.

Load door 38 can have a friction/compression closure system for the sealing of the load door and ash door. The closure system may be comprised of a lever that rotates on an axis with a tensioning device, such as a cam or springs, on one or each side to provide compression and a door that has a surface that the latch will mate with and that surface can have a raised angled step to help with said compression. An automatic auger or other delivery system may be installed in conjunction with load door 38 to deliver any kind of solid fuel into chamber 36.

Figure 2:
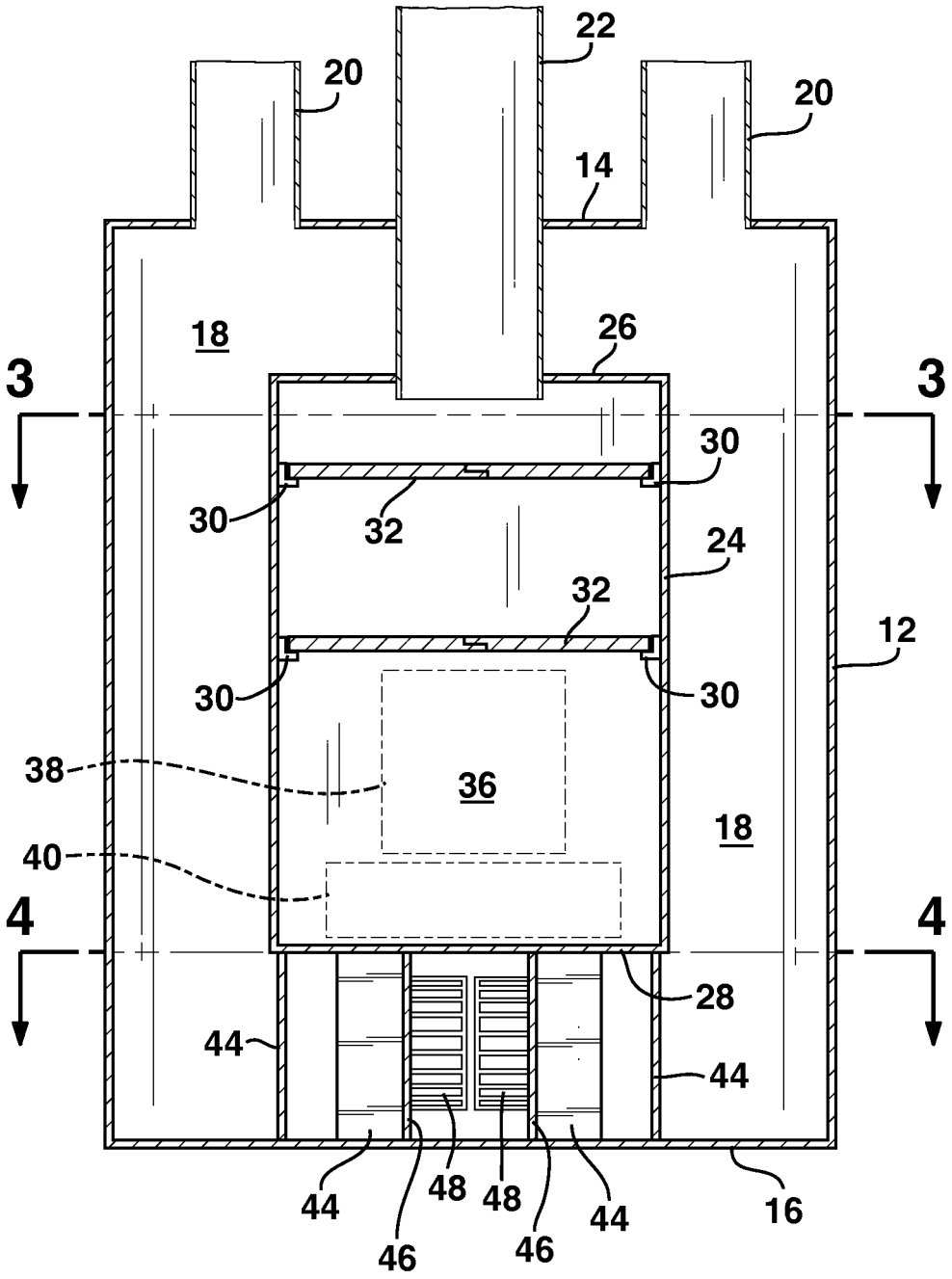
FIG. 2 is a center section view taken from FIG. 1.

FIG. 2 is a center section view taken from FIG. 1. Disclosed in this view is an inside shell 24 with an inside bottom 28 and an inside top 26. The inside shell 24 is a vertical cylinder in the preferred embodiment and forms a chamber 36 therein where the fire is maintained. Protruding from the inside top 26 is a flue 22 that extends though the outside top 14. A space 18 is created between inside shell 24, inside bottom 28, inside top 26 and outside shell 12, outside bottom 16, outside top 14. A load door 38 and an ash door 40 protrude the front side of inside shell 24 to the outside through the outer shell 12. Their relative position is shown in phantom, in this view. Load door 38 and ash door 40 serve as a means to access chamber 36, for example, to add solid fuel and remove ash, respectively. Supports 44 serve as a means to elevate inside shell 24, inside bottom 28 and inside top 26 within space 18. Baffle supports 30 are fixed to the chamber 36 side of the inside shell 24 by welding or any other suitable means. Baffle 32 is comprised of two equal semi circle sections joined in the center by a ship lap connection. In this view the front of blowers/pumps 48 are visible.

Figure 3:
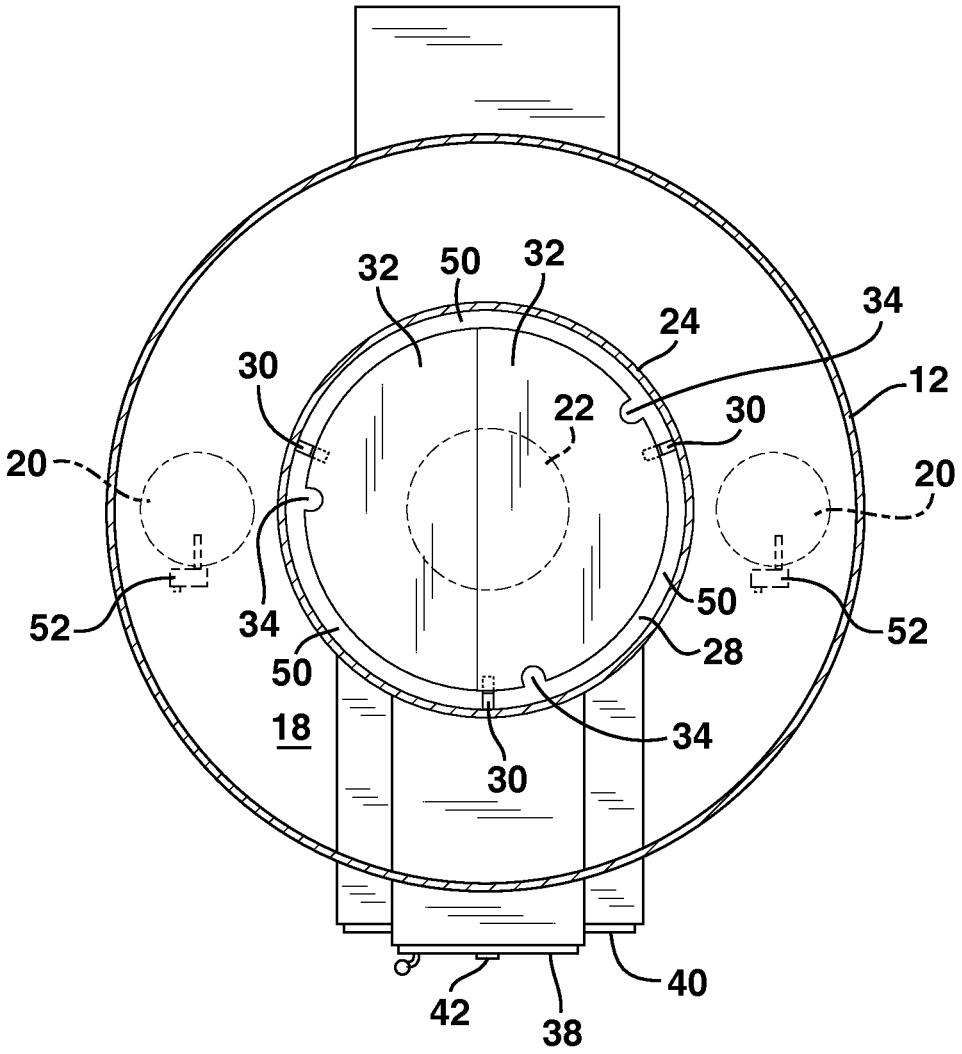
FIG. 3 is a section view taken from FIG. 2.

FIG. 3 is a section view taken from FIG. 2. This view more clearly shows the circular configuration of the entire assembly. In particular are shown the baffles 32 having a diameter smaller than the diameter of the inside shell 24 so that a gap 50 is created along the perimeter of the baffles 32. The baffles 33 may also include notches 34 that are taken from the edges of the baffle 32. Positions of flue 22 and ducts 20 are shown in phantom in relation to the entire appliance.

Figure 4:
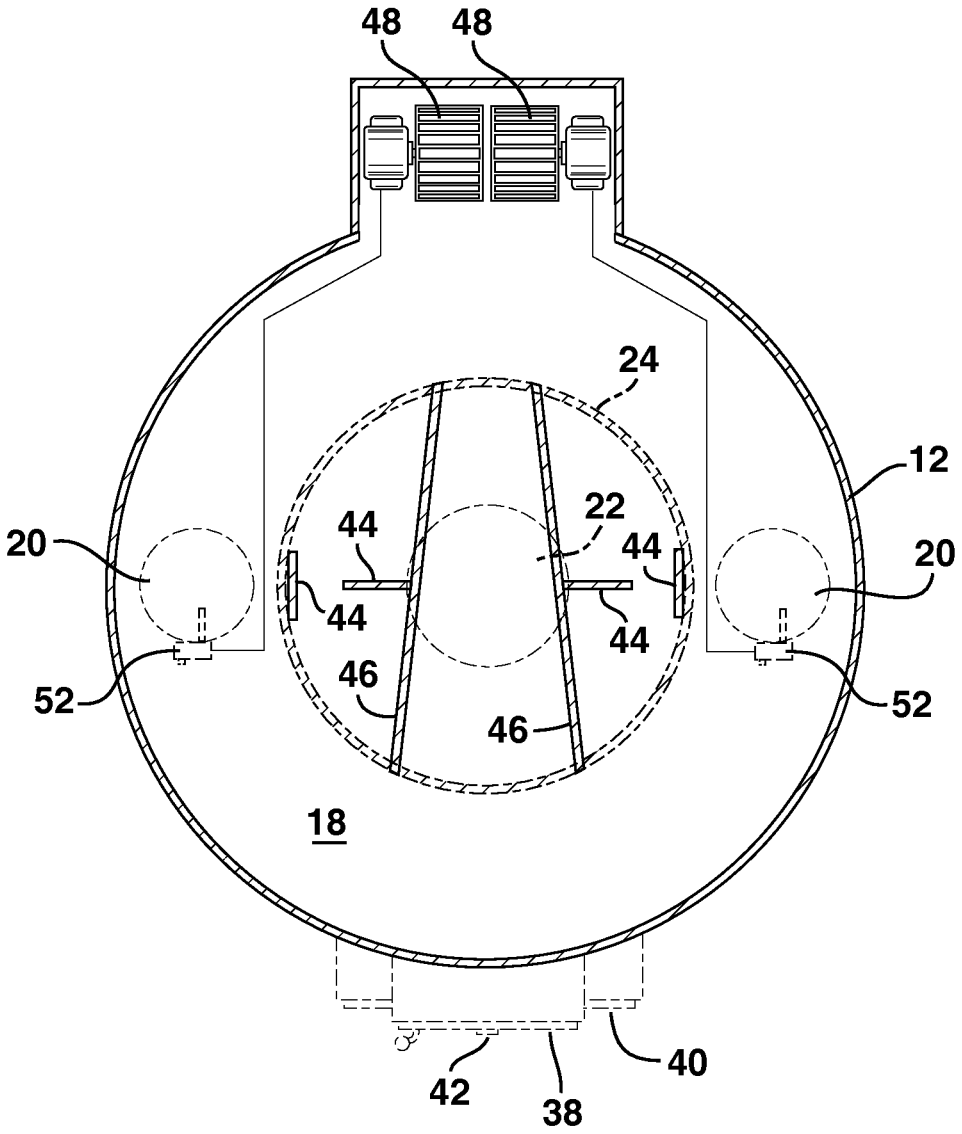
FIG. 4 is another section view taken from FIG. 2.

FIG. 4 is another section view taken from FIG. 2. This view more clearly shows the position of the blowers/pumps 48, positioned in their housing at the lower end of the outer shell 12. Supports 44 are shown in their relative positions supporting inside bottom 28. Deflectors 46 are positioned to direct air or fluid from blower/pump 48 to the front of the space 18.

Figure 5:
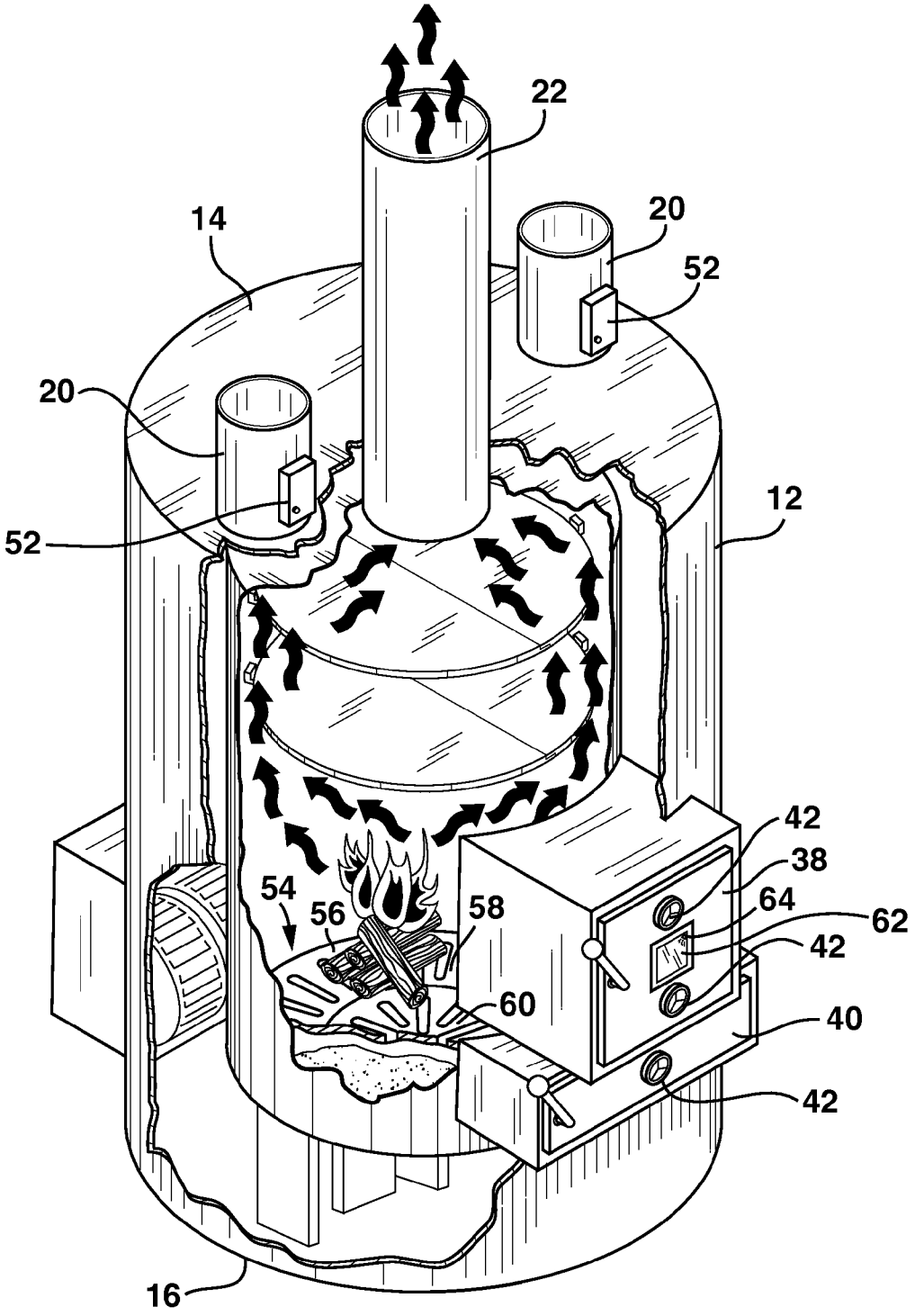
FIG. 5 is a perspective partial cut away view of the solid fuel burning appliance in use.

FIG. 5 shows the solid fuel burning appliance in operation. One uses the appliance in the normal manner by loading wood or other fuel through load door 38 into chamber 36. Fuel is ignited and burns in the chamber 35. For efficiency burn is controlled by draft regulators 42. Exhaust gases do not have a direct route out the flue 22. Exhaust gases are inhibited from traveling in an upward direction by baffles 32 and must continue their upward path around the baffles 32 through the gap between the baffles and the inner shell to escape through flue 22. Flue 22 is set 1 to 2 inches below inside top 26. The heat is dispersed better and the combustion flame is further inhibited from going up the flue 22 by the inset of flue 22.

The vertical nature of flue 22 allows creosote to fall directly back into the furnace, not collecting in flue 22. The baffle 32 will force the flame and exhaust to pass by the gap 50 between the Baffle 32 and the inside, of inside shell 24 causing the inside shell 24 to heat up. In turn the air or fluid in space 18 is heated and forced through ducts 20 by one or more blowers/pumps 48, or induction and delivered to the area being heated. Blowers/pumps 48 are controlled by fan limit switches 52. In the preferred embodiment, when the furnace first heats up one blower/pump 48 will turn on. Once the appliance is hot it will turn on the other blower/pump 48, produce more air or fluid flow and deliver more heat. As the appliance cools down one blower/pump 48 will shut off, with less air or fluid flow. You get the same air or fluid temperature from the appliance but less volume of air or fluid. The exact on and off temperatures may be selected to achieve the desired temperature in the space being heated and/or preferably for controlling the fire in the furnace. In one embodiment there can be a two speed blower/pump 48 that can switch from low speed to high speed or from high speed to low speed automatically.

Operating in this way keeps the appliance at a steady temperature and makes the actual fire in the furnace last longer because the chamber 36 will maintain a constant temperature and thus allow the rest of the heat to transfer to the heat exchanger and space 18. In the preferred embodiment, fan limit switches 52 are instrumental to the movement of cold air or fluid over the chamber 36. If you move too much cold air or fluid over the chamber 36 the heat from the fire will heat inside shell 24, inside bottom 28, and inside top 26, not transferring any heat into the heat exchanger and space 18.

The vertical cylindrical shape of inside shell 24 and outside shell 12 equalizes the heat, pressure and their transference from the inside walls of inside shell 24 and outside shell 12. Corners are eliminated in the preferred embodiment thus eliminating dead spaces created by corners. A more economical and efficient heat distribution is achieved.

In the preferred embodiment, the baffle 32, being circular, can be mounted with a plurality of supports 30. The baffle 32 being constructed in two sections can easily be inserted or removed, a section at a time, in and out of load door 38. As each section of baffle 32 is inserted into chamber 36 they are mutually joined in a ship lap fashion, raised into position with notches 34 clearing supports 30 and rotated until baffle 32 rests on supports 30. Supports 30 as shown in FIG. 2 are configured in a right angle shape. The material thickness in the vertical leg of the angle of support 30 serves to self center the baffle 32. Thus inhibiting the baffle 32 from touching inside shell 24 and preventing hotspots and eventual warping of the inside shell 24. A gap 50 range of 0.25 inch to 2 inches is maintained.

Figure 6:
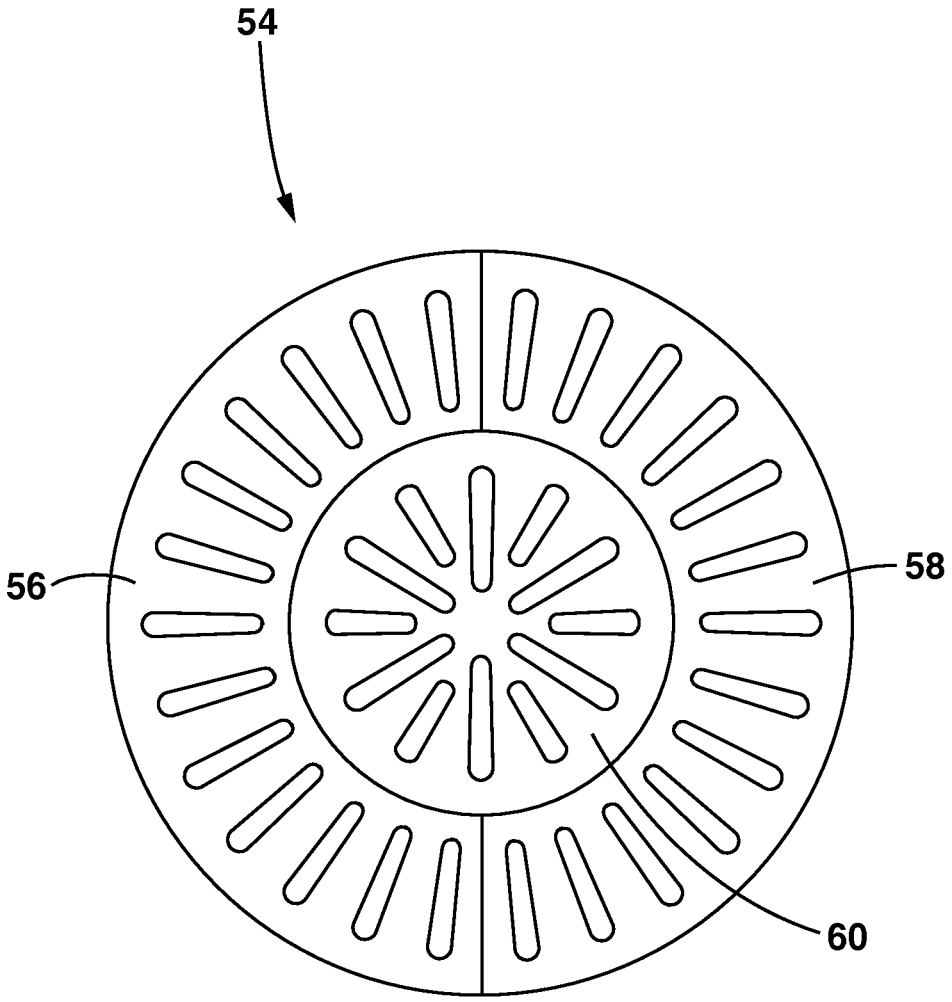
FIG. 6 is a top view of a fire grate for the solid fuel burning appliance.

FIG. 6 shows a fire grate 54 for use in the fire chamber. The fire grate 54 is generally located a certain height above the bottom of the inner shell. Holes in the grate allow ash to fall through the grate and settle to the bottom of the inner shell where the ash can be removed from the ash door. In one embodiment, the grate 54 is made up of two outer fire grate halves 56, 58 that allow the grate 54 to be placed into the fire chamber through at least one of the doors. The fire grate 54 may include a center fire grate 60 section that can be rotated and mounted in the middle of the outer fire grate halves 56, 58. This allows the inner fire grate 60 to be rotated in the fire chamber to cause ash to fall to the bottom of the inner shell. In at least one embodiment, the three piece fire grate 54 that has a two piece constructed exterior circumference design with a ship lap construction that would accept a circular center piece section 60 that is constructed with a ship lap exterior edge to allow, once all assembled, a twisting or shaking action of the center section 60 that will travel by the support of the outside grate sections 56 and 58

ADVANTAGES

An advantage of this invention in one embodiment or variant of the invention is to provide a device for efficiently distributing heat from wood or other fuel.

Another advantage of this invention in one embodiment or variant of the invention is to provide a device of a more economical construction.

Another advantage of this invention in one embodiment or variant of the invention is to provide a device that does not accumulate deposits from flue gases.

Another advantage of this invention in one embodiment or variant of the invention is to provide a device without a hot spot in the back.

Another advantage of this invention in one embodiment or variant of the invention is to provide a device without hot or cold spots.

Another advantage of this invention in one embodiment or variant of the invention is to provide a device with more longevity from operational burnout deterioration.

Another advantage of this invention in one embodiment or variant of the invention is to provide a device with heat baffles that can be serviced through the furnace's load door.

Another advantage of this invention in one embodiment or variant of the invention is to provide a device with self centering heat baffles.

Another advantage of this invention in one embodiment or variant of the invention is to provide a device that ensures against eventual operational warping of the fire chamber.

Another advantage of this invention in one embodiment or variant of the invention is to provide a furnace with a smaller size than a rectangular furnace while having the same BTU rating.

Another advantage of this invention in one embodiment or variant of the invention is to provide a furnace that requires less steel to construct and less solid fuel to heat the chamber to adequate delivery temperature.

From the description above, a number of advantages of some embodiments of my wood burning furnace become evident:

There are many materials and configurations that can be used in constructing the invention by those skilled in the art including various materials, methods and dimensions. In addition, it is clear that an almost infinite number of minor variations to the form and function of the disclosed invention could be made and also still be within the scope of the invention. Consequently, it is not intended that the invention be limited to the specific embodiments and variants of the invention disclosed. It is to be further understood that changes and modifications to the descriptions given herein will occur to those skilled in the art. Therefore, the scope of the invention should be limited only by the scope of the claims.

I claim:

1. A solid fuel burning appliance comprising:

a first vertical cylindrical shell having an interior, a bottom and an top;

a second vertical cylindrical shell having an interior, a bottom and top, the second shell located within the interior of the first shell therewith creating a space between the first and second shells;

a flue extending out of the top of the second shell through the top of the first shell;

at least one duct extending out of the first shell;

a load door and an ash door, each door providing access to the interior of the second shell;

a fire grate located within the second shell, the interior of the second shell forming a chamber comprising at least one two-piece circular baffle removably located within the chamber vertically above the grate, the two-piece circular baffle comprising first and second semicircular sections joined with a ship lap connection; and a pair of deflectors located between the bottom of the first shell and the bottom of the second shell, the pair of deflectors elevating the bottom of the second shell above the bottom of the first shell, the pair of deflectors comprising a first pair of non-parallel plates oriented to direct air or fluid flow between the second and the first shell so as to control a fire within the combustion chamber within the second shell, and a second pair of plates substantially perpendicular to the first pair of non-parallel plates, each of the second pair of plates protruding from at least one of the first pair of non-parallel plates.

2. The appliance of claim 1, wherein the chamber has a diameter and the circular baffle has a diameter smaller than the diameter of the flue, the baffle located in the chamber such that a gap is created along the perimeter of the baffle.

3. The appliance of claim 2, wherein the baffle is centered within the chamber to provide a uniform gap along the perimeter of the baffle.

4. The appliance of claim 2, wherein baffle includes a plurality of notches located along the perimeter of the baffle.

5. The appliance of claim 3, comprising at least one blower or pump in communication with the space between the first and second shells such that when operating causes air or fluid to circulate through the space and in or out of the at least one duct.

6. The appliance of claim 5, comprising at least one limit switch coupled to the at least one blower or pump to provide a first flow of air through the furnace at a first predetermined temperature and a second flow of air or fluid through the appliance at a second predetermined temperature higher than the first temperature.

7. The appliance of claim 6, wherein the blower or pump is located in the bottom of the first shell opposite the load door and the ash door.

8. The appliance of claim 1, wherein at least one of the second shell and the first shell are constructed with sheet steel.

9. The appliance of claim 1, the fire grate comprising a circular inner fire grate section rotatably mounted in the fire grate.

10. The appliance of claim 1, wherein at least one of the doors includes a compression closure system for sealing at least one of the doors.

11. The appliance of claim 1, wherein at least one of the doors includes a glass window and an air wash system for keeping the glass window clean.

12. The appliance of claim 1, comprising an automatic solid fuel delivery system.

13. The appliance of claim 4, comprising a plurality of supports that support the at least one baffle within the second shell when the baffle is rotated in a first position within the chamber, wherein the plurality of supports are spaced along a perimeter of the chamber to allow the plurality of notches in the at least one baffle to be aligned with the plurality of supports when the at least one baffle is rotated in a second position and to allow the at least one baffle to be removed from the chamber.

* * * * *